United States Patent [19]

Kuester

[11] 4,047,618

[45] Sept. 13, 1977

[54] CRANE CONSTRUCTION AND METHOD OF OPERATION

[75] Inventor: Donald A. Kuester, Wausau, Wis.

[73] Assignee: J. I. Case Company, Racine, Wis.

[21] Appl. No.: 614,411

[22] Filed: Sept. 18, 1975

[51] Int. Cl.[2] ..... B66C 23/06

[52] U.S. Cl. ..... 212/58 R; 212/55; 212/144; 52/115; 214/141; 214/152

[58] Field of Search ..... 212/54–55, 212/58 R, 46 R, 46 A, 46 B, 144; 52/115–116, 118; 214/152, 141

[56] References Cited

U.S. PATENT DOCUMENTS

| | | | |
|---|---|---|---|
| 3,572,517 | 3/1971 | Liebherr et al. | 212/144 |
| 3,939,988 | 2/1976 | Wellman | 212/46 A |

FOREIGN PATENT DOCUMENTS

| | | | |
|---|---|---|---|
| 794,193 | 9/1968 | Canada | 212/55 |
| 707,991 | 7/1966 | Italy | 212/46 B |
| 1,130,242 | 10/1968 | United Kingdom | 212/55 |

*Primary Examiner*—Robert J. Spar
*Assistant Examiner*—R. B. Johnson
*Attorney, Agent, or Firm*—Dressler, Goldmsith, Clement, Gordon & Shore, Ltd.

[57] ABSTRACT

A crane having a multisection telescopic boom is disclosed herein. The multisection boom is designed so that the intermediate and forward sections can be moved rearwardly with respect to the base section to decrease the overall length of the crane for transportation purposes.

4 Claims, 4 Drawing Figures

CRANE CONSTRUCTION AND METHOD OF OPERATION

BACKGROUND OF THE INVENTION

The present invention relates generally to cranes of the type disclosed in U.S. Pat. No. 3,657,969, issued Apr. 25, 1972, and assigned to the assignee of the present invention.

Mobile cranes of the type disclosed in this patent generally consist of a vehicle that has a turntable base or support rotatable about a vertical axis on the frame of the vehicle A crane boom is generally pivoted about a horizontal axis on the support and is raised and lowered by fluid rams.

In recent years, it has become customary to increase the versatility of the unit by forming the boom in a plurality of telescoping sections which are extensible and retractable relative to each other. Generally, these sections are of hollow polygonal configuration and are nestable within each other in a retracted position. The extension and retraction of the sections with respect to each other is generally accomplished through the use of fluid rams having cylinders and piston rods respectively connected to adjacent boom sections so that extension and retraction of the ram will cause extension and retraction of the two sections.

Because of the extreme cost of large units of this type, manufacturers are constantly striving to increase the versatility of the machine without increasing the cost thereof. For example, multisection booms for cranes of this type have been designed so that the maximum length of the boom in the fully extended position approaches 100 feet. However, there are certain limits in lengths of the boom sections which cannot be exceeded and still have the unit capable of being transported along major highways.

SUMMARY OF THE INVENTION

The present invention provides a simple method of decreasing the overall length of a crane for transportation purposes while still maintaining the versatility of the unit.

More specifically, the present invention contemplates repositioning the boom sections for transportation purposes so that the overhang of the boom with respect to the main frame of the vehicle is substantially reduced.

The above is accomplished by having the base section of a multisection boom of less length than the remaining sections so that a first intermediate section received into the base section and all subsequent sections can be shifted rearwardly within the base section for transportation purposes.

According to the present invention, this is accomplished by utilizing the fluid ram that is located between the base section and the first intermediate section. The fluid ram which has its cylinder connected to the intermediate section and a piston rod connected to the rear end of the base section is designed so that the piston rod can be disconnected from the base section, the fluid ram partially extended so that the piston rod can be connected to the fixed support at a location spaced from the rear end of the base section and all of the remaining boom sections can then be retracted by retracting the fluid ram to thereby decrease the overall length of the crane.

The apparatus for the present invention consists of a crane that has a multisectional boom which includes at least a base section and one intermediate section that has a length which is greater than the base section. The base section has its rear end pivotally supported on a fixed support and has means defining a first connection for a piston rod that forms part of the extending and retracting mechanism between the base section and the first intermediate section. The crane of the present invention also has a second connection for the piston rod on the fixed support at a location spaced from the rear end of the base section so that the piston rod can be disconnected from the base section, the fluid ram extended and connected to the second connection and subsequently retracted to cause the intermediate section as well as all sections supported therein to be moved rearwardly and decrease the overall length of the crane.

DETAILED DESCRIPTION

Figures 1, 2, 3, 4:
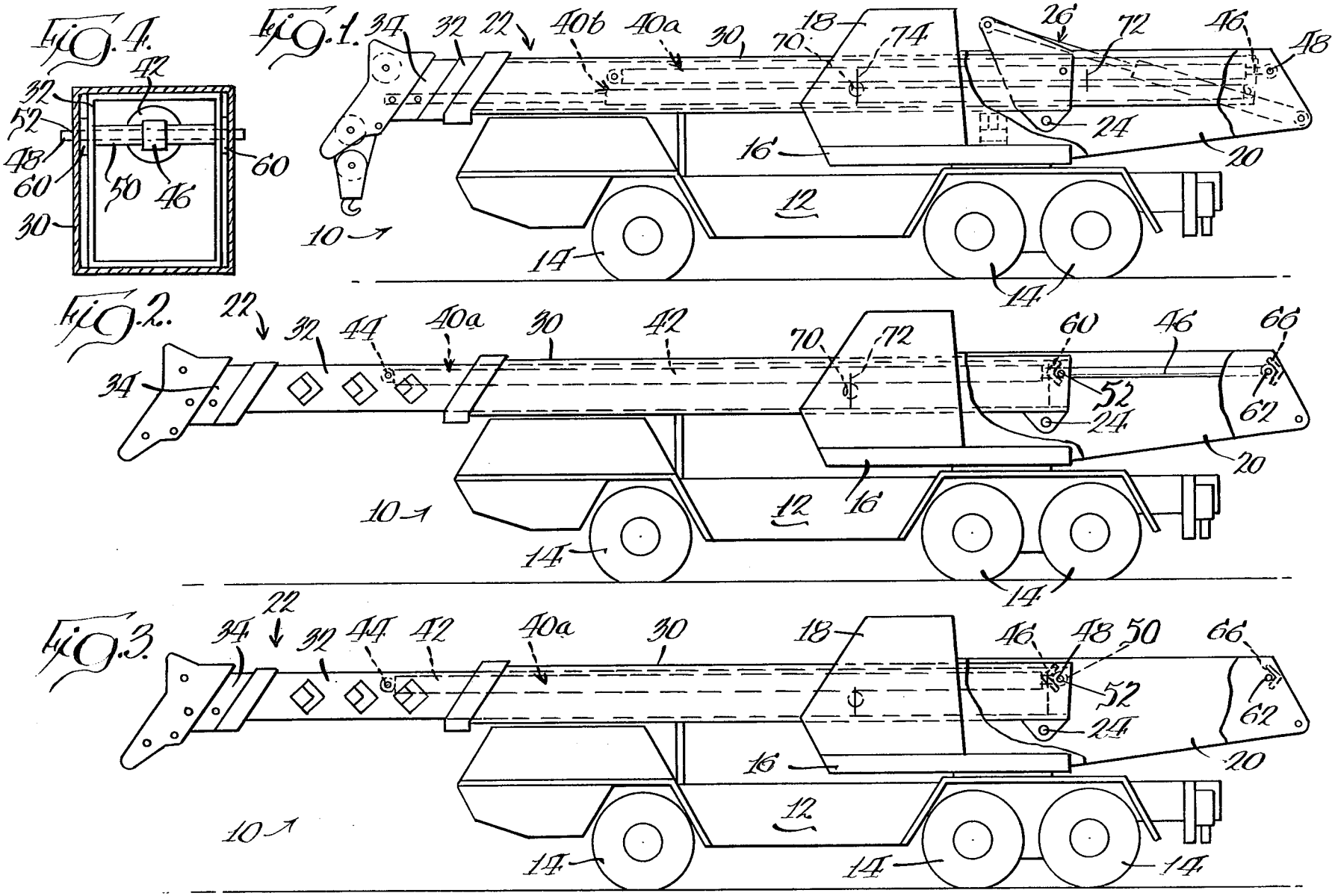
FIG. 1 of the drawings shows a crane having the boom thereon suppported in a transport position.
FIG. 2 is a view similar to FIG. 1 showing the crane and boom as it is being converted from the transport position to a working position.
FIG. 3 is a view similar to FIG. 2 showing the crane and boom in a working position.
FIG. 4 is a transverse sectional view of a portion of the boom with certain sections being deleted for purposes of clarity.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIGS. 1, 2 and 3 of the drawings disclose a crane 10 consisting of a vehicle frame 12 supported on wheels 14 with a turntable 16 supported for rotation about a vertical axis on frame 12. Turntable 16 has a cab 18 and a fixed support 20 supported thereon. Fixed support 20 rotates wth turntable 16 and supports a multisection crane boom 22 for movement about a horizontal pivot axis defined by a pin 24 through fluid rams 26.

Multisection boom 22 consists of a base section 30, one or more intermediate sections 32 and an outer end section 34. Each of the sections of the boom are telescoped within the previous section and are moved between extended and retracted positions by fluid rams **40*a* and 40*b***. The fluid rams and the hydraulic circuit associated therewith for supplying fluid thereto may be of the type disclosed in the above mentioned patent, the portions of which are not inconsistent herewith, being incorporated by reference.

According to the present invention, the boom sections 30, 32 and 34 are constructed and arranged so that the overall length of the crane may be decreased for transportation purposes.

FIG. 3 of the drawings shows the crane and boom in its fully retracted working position wherein the boom sections can be in extended and retracted relative to each other and the boom may be pivoted about horizontal pivot 24 while turntable 16 can be rotated on frame 12 through proper manipulation of hydraulic control circuits (not shown). As shown in FIG. 3, the overall length of intermediate and outer boom sections 32 and 34, is substantially greater than the overall length of boom section 30 so that boom sections 32 and 34 extend beyond the forward end of the base section 30 when the boom sections are in the fully retracted position as illustrated in FIG. 3.

FIG. 3 also illustrates hydraulic fluid ram 40*a* (the other fluid ram being deleted from this figure for purposes of clarity) as including a cylinder 42 having one end connected at 44 to intermediate boom section 32. Fluid ram 40*a* also has a piston rod 46 which is connected by a pin 48 to the inner or rear end of base section 30.

An illustrated type of connection between piston rod 46 and base section 30 (FIG. 4) may include a sleeve or member 50 attached to the outer end of piston rod 46 with pin 48 extending through sleeve 50 and openings 52 in the walls of base section 30 at the rear end thereof. Of course, suitable reinforcing elements (not shown) could be utilized to rigidify this connection. Thus, pin 48 and openings 52 define first means defining a first connection for the piston rod adjacent the rear end of the base section of boom 22.

The inner surface of the rear end of base section 30 also has a pair of V-shaped stops 60 for a purpose that will be described later.

The remainder of the structure for reducing the overall length of crane 10 consists of a pair of openings 62 located on fixed support 20 with these openings defining second means on the fixed support which defines a second connection for the piston rod at a location spaced from the rear end of base section 30 of boom 22.

During normal operation of the boom in the working position, piston rod 46 is connected to the rear end of base section 30 through pin 48 and openings 52. If, the operator wishes to place the boom in a transport position, it is only necessary for him to fully retract boom 22 to the position illustrated in FIG. 3. With the boom in this condition, a valve (not shown) is closed to prevent supplying fluid to fluid ram 40*b*. The operator then removes pin 48, and extends piston rod 46 with respect to cylinder 42 by proper manipulation of the controls normally utilized for extending and retracting the boom sections relative to each other. This position may be defined by appropriate stops or guide means 66 located in the path of movement of sleeve 50 on the outer end of piston rod 46. The operator then inserts pin 48 through openings 62 and upon retraction of fluid ram 40*a*, the intermediate boom section and all boom sections supported therein will be moved from the position illustrated in FIG. 3 to that illustrated in FIG. 1 wherein the overhanging portion of boom sections 32 and 34 extends rearwardly of the rear end of boom section 30. This, of necessity, substantially decreases the overall length of crane 10 for transportation purposes. The vehicle is thus ready for being transported from one site to another. During this transportation, piston rod 46 of fluid ram 48 remains connected to fixed support 20 through pin 40*a* and the valve (not shown) for supplying fluid to ram 40*b* remains closed to insure that the boom sections cannot be extended during transportation.

Once the vehicle is at a subsequent job site, it is only necessary for the operator to extend fluid ram 40*a* to a position where boom section 32 has its rear end located within the rear end of boom section 30, as illustrated in FIG. 2. This position may be defined by indicating means on base section 30 and intermediate section 32. For example, base section 30 may have a hole 70 produced in one sidewall adjacent the operator's cab 18. The intermediate section could have some type of painted line 72 (FIG. 2) thereon which would be in alignment with and visible through opening 70 when the base section 30 and intermediate section 32 are in a working position and a second line 74 indicating when the boom is in a stored position. Thereafter, the operator need only remove pin 48 from openings 62, retract the fluid ram until the piston rod 46 is in a fully retracted position illustrated in FIG. 3, and extend pin 48 through openings 52 and sleeve 50. To define this position, the V-shaped stops 60 are positioned so as to guide the sleeve 50 to a position where pin 48 could readily be inserted.

Summarizing, the present invention contemplates decreasing the overall length of a crane having a multisection boom that includes a base section and an intermediate section telescoped within the base section and moved with respect thereto by a fluid ram having a cylinder connected to the intermediate section and a piston rod connected to the base section. The method consists of the steps of disconnecting the piston rod from the base section, partially extending the fluid ram to align the end of the piston rod with openings on the fixed support, which define a second connection, connecting the piston rod to the fixed support and retracting the fluid ram so that the overall length of the crane is decreased by repositioning the overhanging portion of the intermediate and other sections with respect to the base section.

What is claimed is:

1. In a crane having a fixed boom support thereon, a multisectional boom including a base section having a rear end pivoted on said support and at least one intermediate section telescoped within said base section and normally having an overhanging portion extending beyond the forward end of the base section in a retracted working position, a fluid ram having its cylinder connected to said intermediate section and a piston rod extending therefrom, first means on said base section defining a first connection for said piston rod adjacent the rear end of said base section, and second means on said fixed boom support rearwardly of the rear end of said base section defining a second connection for said piston rod, said second connecting means having guide means for guiding said piston rod into alignment therewith so that said piston rod can be disconnected from said first connection on said base section, so that said piston rod can be extended, guided by said guide means into alignment with said second connection and connected to said second connection, whereby said cylinder can be retracted to move said intermediate section from said retracted working position to a stored position wherein said overhanging portion is telescoped into said base section and an opposite end portion is moved beyond said rear end of said base section to reduce the overall length of said crane.

2. A crane as defined in claim 1, wherein said guide means includes stop means to limit the travel of said piston rod while being moved between said first and second connections.

3. A crane as defined in claim 1, further including indicating means between said boom sections for indicating when said intermediate boom section is in said retracted working position.

4. A method of decreasing the length of a crane having a plurality of spaced supports thereon, a multisection crane boom including a base section having the rear end pivotally supported about a horizontal pivot on one of said fixed supports and at least one intermediate section telescoped within said base section by a fluid ram having a first element connected to said intermediate section and a second element connected to said base section, said intermediate section having a portion extending beyond the forward end of said base section when said first element is fully retracted, the steps of disconnecting said second element from said base section, partially extending said second element, connecting said second element to a second one of said fixed supports at a location rearwardly of the rear end of said base section, and retracting said first element to telescope said overhanging portion of said intermediate section into said base section while moving the opposite end of the intermediate section beyond the rear end of the base section so that the overall length of said crane is decreased.

* * * * *